United States Patent [19]

Black et al.

[11] Patent Number: 4,531,115

[45] Date of Patent: Jul. 23, 1985

[54] REMOTE ALARM SYSTEM

[75] Inventors: Donald Black, Indianapolis; James D. Pirtle, Lawrence, both of Ind.

[73] Assignee: Emhart Industries, Inc., Indianapolis, Ind.

[21] Appl. No.: 402,154

[22] Filed: Jul. 26, 1982

[51] Int. Cl.[3] ..... G08B 1/08

[52] U.S. Cl. ..... 340/539; 340/527; 340/531; 455/63

[58] Field of Search ..... 340/539, 531, 527, 528; 455/63, 50, 67

[56] References Cited

U.S. PATENT DOCUMENTS

| | | | |
|---|---|---|---|
| 3,544,987 | 12/1970 | McMann, Jr. et al. | 340/539 |
| 3,833,895 | 9/1974 | Fecteau | 340/539 |
| 4,148,020 | 4/1979 | Siemer et al. | 340/539 |
| 4,157,540 | 6/1979 | Oros | 340/539 |

*Primary Examiner*—Donnie L. Crosland
*Attorney, Agent, or Firm*—Robert F. Meyer

[57] ABSTRACT

A remote alarm system provides a transmitter having an audio frequency signal generator circuit, a modulator circuit forming a current source modulated by the audio frequency signal and a radio frequency oscillator circuit modulated by the current source, and a receiver having a super-regenerative detector, an amplifier connected thereto, a notch filter for selectively filtering the audio frequency signal, an alternating current rectifier for rectifying the audio frequency signal, a delay circuit for delaying activation of an alarm signal until a signal from the rectifier circuit is present for a predetermined amount of time and for determining a period of time for activation of an alarm signal, and an alarm means for generating an alarm signal in response to the output of the delay circuit.

8 Claims, 4 Drawing Figures

REMOTE ALARM SYSTEM

BACKGROUND OF THE INVENTION

1. Field Of The Invention

The present invention generally relates to remote alarm systems and, in particular, to such systems where a radio transmission is used to signal a remote receiver.

2. Statement Of The Prior Art

Since their inception, remote alarm systems have proven extremely useful in a variety of applications. Generally, such systems include a transmitter connected to monitor a condition and a receiver for notifying the carrier thereof of the monitored change in condition. Such systems are generally useful wherever a person who moves around a lot must be quickly notified of the change or existance of a given condition. Applications of remote alarm systems vary from paging applications to full scale voice communication systems. Generally, the most important requirement for such remote alarm systems is that they have a receiver which is highly reliable. That is, the receiver must be capable of rejecting all signals which are not genuine alarm signals and sounding an alarm in response to all signals which do constitute a genuine alarm signal.

SUMMARY OF THE INVENTION

Accordingly, a remote alarm system includes: a transmitter; circuit means, included in the transmitter, for generating an audio frequency electrical signal; means for activating said circuit means for generating; modulator circuit means, included in the transmitter coupled to the circuit means for generating, for forming a current source modulated by the circuit means for generating; radio frequency oscillator circuit means included in the transmitter and coupled to the modulator circuit means for being modulated by the modulated current source; antenna means coupled to the radio frequency oscillator circuit means for transmitting signals therefrom; a receiver; antenna means for receiving transmissions from the antenna means for transmitting; super-regenerative detector means included in the receiver and coupled to the antenna means for receiving; amplifier means included in the receiver and coupled to the detector means for amplifying signals therefrom; notch filter means included in the receiver and coupled to the amplifier for selectively filtering the audio frequency of the circuit means for generating; alternating current rectifier means included in the receiver and coupled to the filter means for converting any audio frequencies filtered by the filter means into a direct current signal; delay circuit means included in the receiver and coupled to the rectifier means for delaying activation of an alarm signal until the direct current signal is present for a predetermined amount of time and for determining a period of time for activation of an alarm signal; and alarm means coupled to the delay circuit means for generating an alarm signal in response to the delay circuit means.

BRIEF DESCRIPTION OF THE DRAWINGS

The present invention is illustratively described and shown in respect to the appended drawings in which.

DETAILED DESCRIPTION OF THE DRAWINGS

Figure 1:
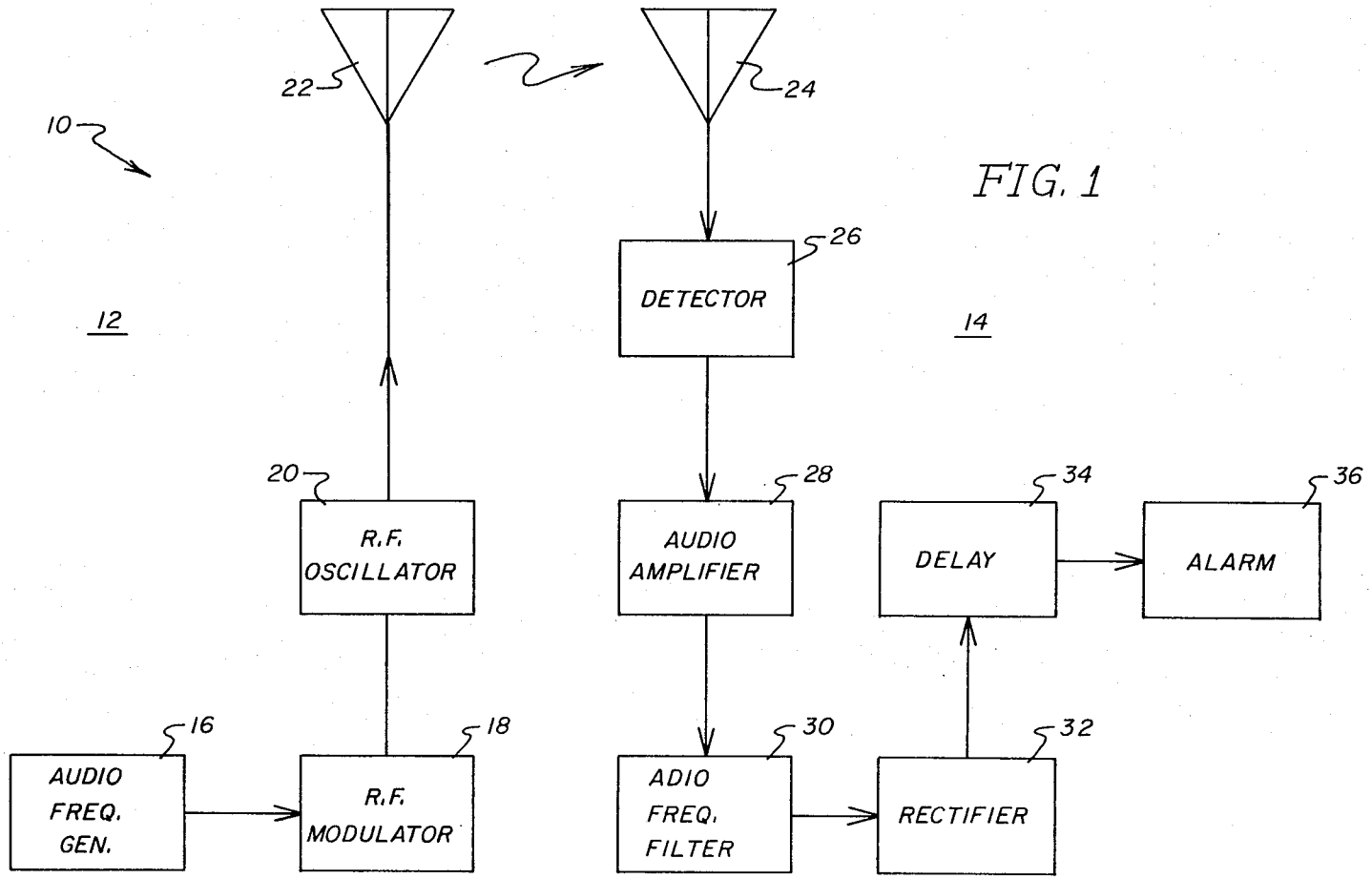
FIG. 1 is a block diagram of an audio alarm system constructed in accordance with one embodiment of the present invention.

In reference to FIG. 1, a remote alarm system 10 generally includes a transmitter 12 and a receiver 14. The transmitter 12 generally includes an audio frequency electrical signal generator circuit 16, a radio frequency modulator 18 and a radio frequency oscillator 20. An antenna 22 is coupled to the output of the radio frequency oscillator 20. The audio frequency signal generator circuit 16 may be made condition responsive for generating a signal in response to a change or the existance of a monitored condition. The output of the audio frequency signal generator 16 is coupled to the radio frequency modulator 18 which includes a current source for modulation by the audio frequency electrical signal. The output of the radio frequency modulator 18 is coupled to the radio frequency oscillator 20 for causing the radio frequency oscillator to be modulated by the current source including the audio frequency signal. The signal thus generated is transmitted by the antenna 22 to the receiver 14.

Receiver 14 generally includes a receiving antenna 24, a super-regenerative detector 26, an audio amplifier 28, an audio frequency notch filter 30, an alternating current rectifier 32, a delay circuit means 34, and an alarm signal generator 36. When a signal is received by the antenna 24, it is connected to the super-regenerative detector 26 which amplifies any received radio frequencies at the frequency for which it is tuned and separates the radio frequency components therefrom. The remaining audio frequency signal is coupled to the audio amplifier 28 for amplification. The output of amplifier 28 is coupled to the audio frequency notch filter 30 which filters out all of the audio frequencies except for the frequency to which the audio frequency signal generator 16 is tuned. The resulting signal is coupled to the alternating current rectifier which converts alternating current to a direct current signal indicative of the presence of the transmitted audio frequency signal. The direct current signal from rectifier 32 is coupled to a delay circuit 34 which requires that the direct current signal be present for a predetermined amount of time. This is to insure that the audio frequency electrical signal was indeed a transmitted alarm signal and not a spurious non-alarm signal. Once the direct current signal is present for the predetermined amount of time, a signal is then coupled to the alarm generator 36 which creates an alarm signal of some form such as an audio alarm.

Figure 2:
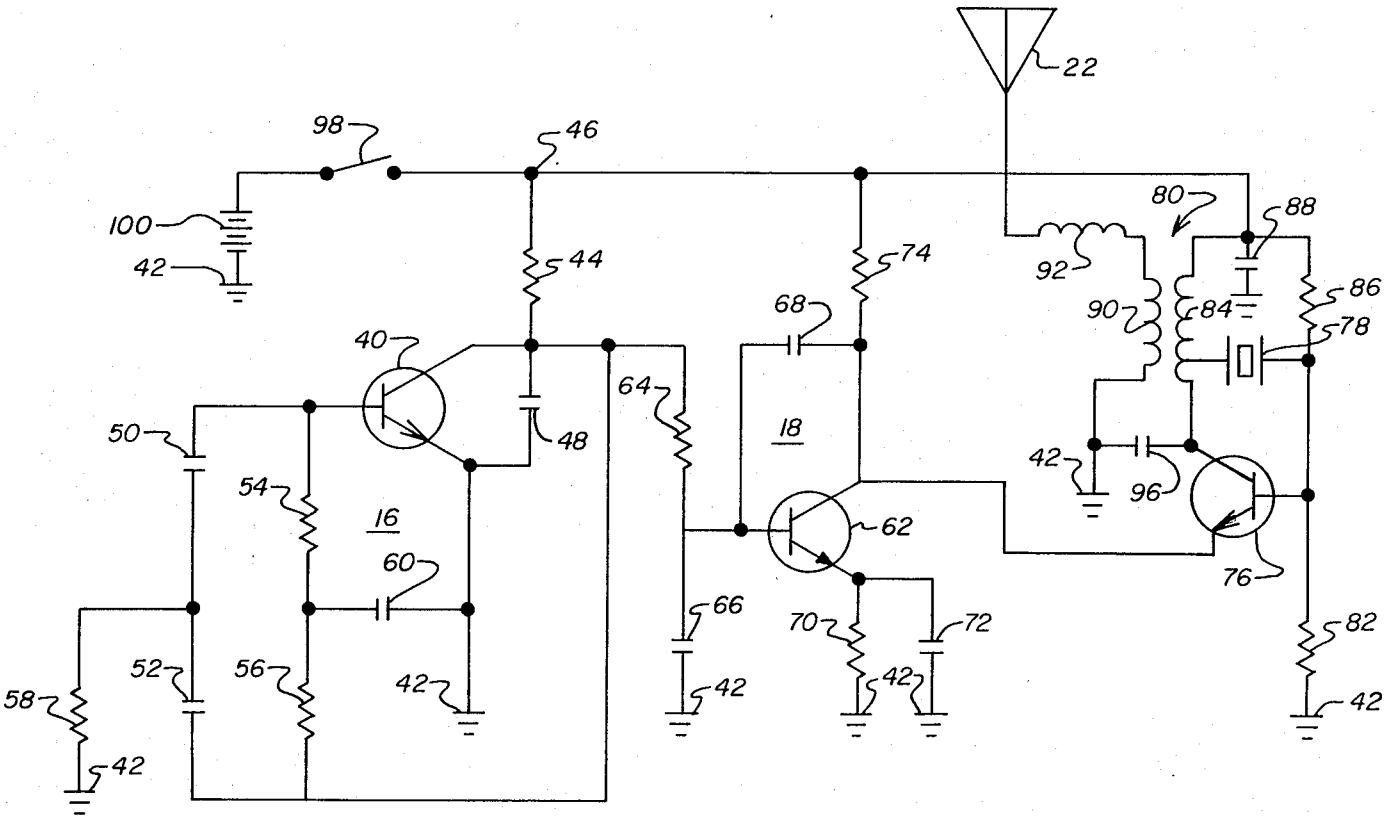
FIG. 2 is a circuit diagram of a transmitter constructed in accordance wth the embodiment of FIG. 1.

In reference to FIG. 2, the audio frequency signal generator circuit means 16 includes a twin-T oscillator constructed around an NPN transistor 40. The emitter of transistor 40 is coupled to the circuit ground 42 and the collector is coupled through a resistor 44 to a voltage source point 46. Source point 46 and its supply of electrical power are described in greater detail below. A capacitor 48 is connected between the emitter and collector of transistor 40. A pair of series connected capacitors 50 and 52 and a pair of series connected resistors 54 and 56 are connected in parallel and between the base of transistor 40 and the collector thereof. A resistor 58 is coupled between the interconnection of capacitors 50 and 52 and the circuit ground 42 and a capacitor 60 is coupled between the interconnection of resistors 54 and 56 and the circuit ground 42. The output of the audio frequency signal generator circuit 16 appears at the collector of transistor 40 and in the present embodiment, is set for a frequency value of approximately 1 killohertz.

The radio frequency modulator circuit 18 is constructed around an NPN transistor 62 and receives an input signal from the generator circuit 16 via a resistor 64 coupled from the collector of transistor 40 to the base of transistor 62. A pair of capacitors 66 and 68 couple the base of transistor 62 to the circuit ground 42 and to its own collector. The parallel combination of a resistor 70 and a capacitor 72 couple the emitter of transistor 62 to the circuit ground 42. The output of the radio frequency modulator circuit 18 appears at the collector of transistor 62 which is connected via a resistor 74 to the voltage source point 46.

The radio frequency oscillator circuit 20 generally includes an NPN transistor 76, an oscillating crystal 78, and a transformer 80. The emitter of NPN transistor 76 is connected to the collector of transistor 62 and has its base connected through a resistor 82 to the circuit ground 42. Transformer 80 includes a primary coil 84 having one end thereof coupled to the collector of transistor 76 and the other end coupled to the voltage source point 46. A resistor 86 couples the base of transistor 76 to the voltage source point 46 and a capacitor 88 couples the voltage source point 46 to the circuit ground 42. The crystal 78 is coupled from the base of transistor 76 to a tap in the primary coil 84 of transformer 80. The secondary coil 90 of transformer 80 is connected between the circuit ground 42 and one end of a loading coil 92. The other end of loading coil 92 is connected to the transmission antenna 22. A capacitor 96 is connected between the collector of transistor 76 and the circuit ground 42.

The voltage source point 46 is connected to one of a pair of contacts for a switch 98, the other of which is connected to a positive terminal of a 9-volt battery. The negative terminal of a 9-volt battery is connected to the system ground 42. The switch 98 is representative of a condition to be monitored. Thusly, it may be adapted to represent a variety of conditions simply depending upon the type of switch 98 used.

When the condition being monitored changes or begins or ceases to exist, the switch 98 is closed to apply the supply voltage to the voltage source point 46. This activates the entire transmitter circuit 12 causing the audio frequency oscillator 16 to oscillate at approximately 1 killohertz. This in turn creates a modulating current source at the collector of transistor 62 which is fed into the RF oscillator 20. The modulated audio and radio frequencies are then transmitted by the transmitter antenna 22.

Figure 3:
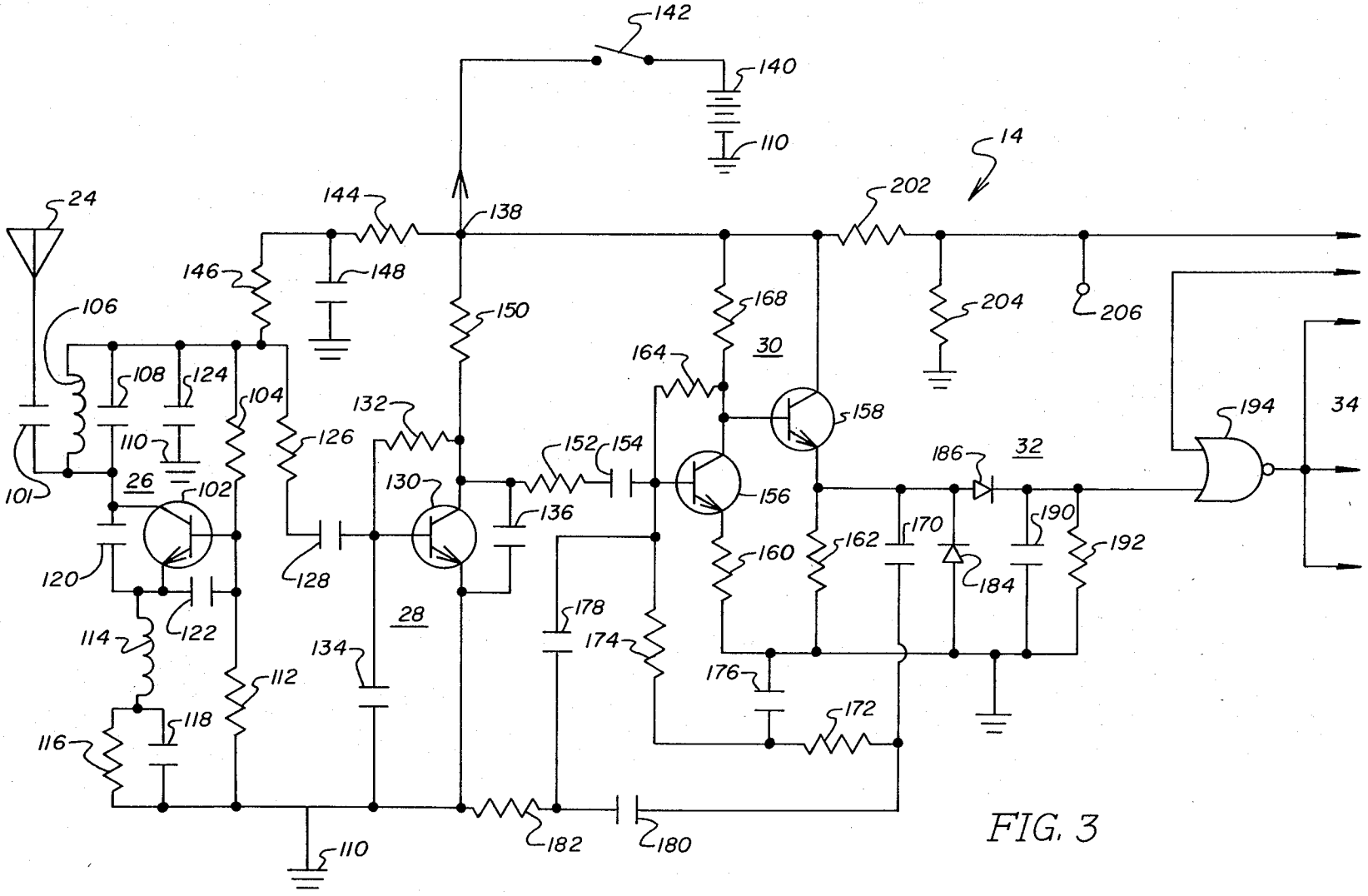
FIGS. 3 and 4 constitute a circuit diagram, when aligned in accordance with the reference arrows thereon, of a receiver constructed in accordance with the embodiments of FIGS. 1 and 2.
Figure 4:
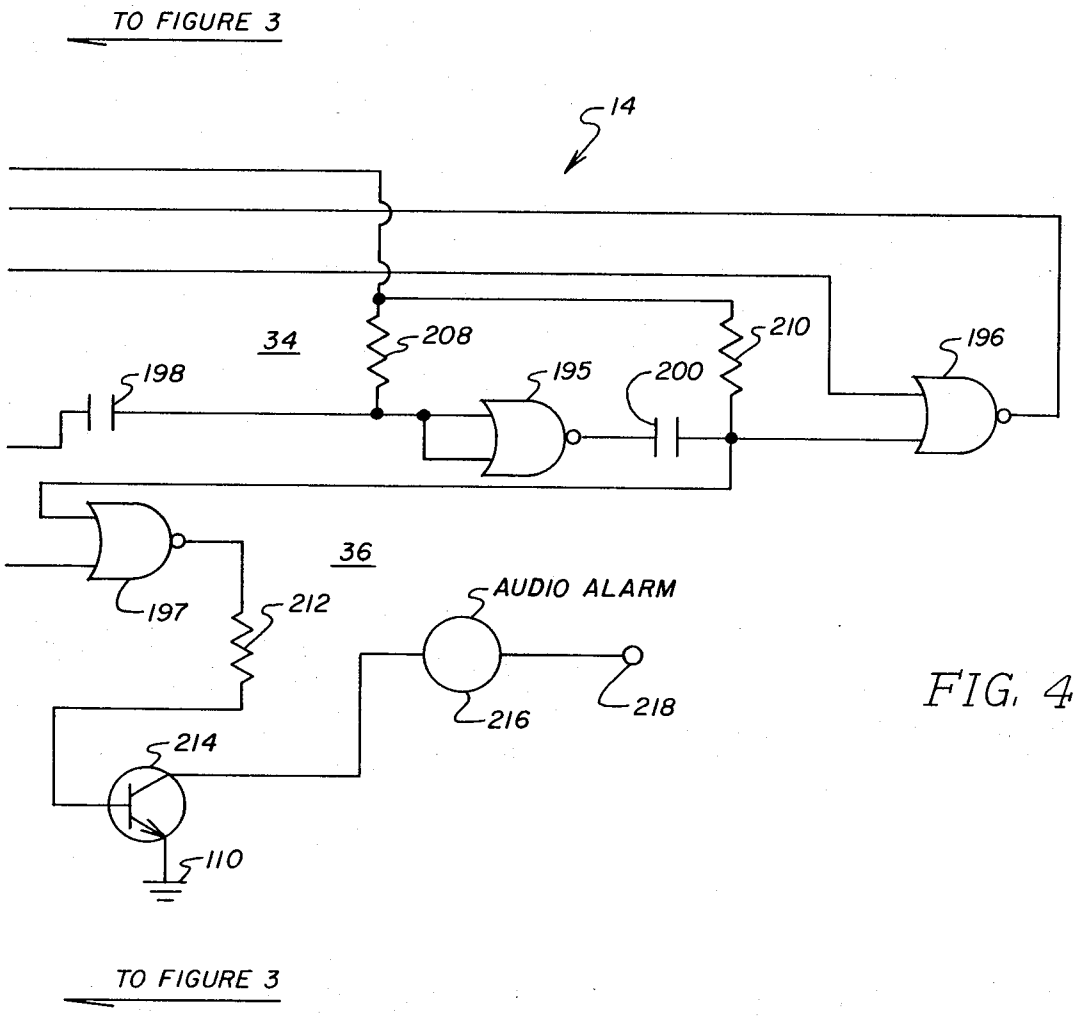

FIGS. 3 and 4 show a schematic circuit for a receiver 14 constructed in accordance with FIG. 1. FIGS. 3 and 4 may be aligned in accordance with the reference arrows to the other Figure located on each sheet. The schematic of FIGS. 3 and 4 shows the receiver 14 having the receiving antenna 24 connected by a capacitor 101 to a super-regenerative detector circuit 26. Detector circuit 26 generally includes an NPN transistor 102 having its collector connected to the capacitor 101. The circuit further includes a feedback path from the base of transistor 102 to the collector thereof via a resistor 104 connected in series with a tank oscillator including a transformer 106 and a capacitor 108. The base of transistor 102 is connected to a circuit ground 110 for the receiver via a resistor 112. The emitter of transistor 102 is connected to the circuit ground 110 by a coil 114 connected in series with the parallel combination of a resistor 116 and a capacitor 118. Additional capacitors 120, 122 and 124 are respectively connected between the collector and emitter of transistor 102, the emitter and base of transistor 102, and the receiver ground 110 and the output of the super-regenerative detector 26, which is present at the interconnection between resistor 104 and the transformer 106. Capacitors 118, 120, 122, coil 114 and resistor 116 perform a quenching function for the detector 26 while capacitor 124 filters out the r.f. component to the circuit ground 110.

The output of the super-regenerative detector 26 is connected via a resistor 126 and a capacitor 128 to the audio frequency amplifier 28 of FIG. 1. Amplifier 28 generally includes an NPN transistor 130 connected in a common emitter configuration with its emitter connected to the receiver ground 110. A feedback resistor 132 connected between the collector and base of transistor 130 and capacitors 134 and 136 are connected between the base and the emitter and between the emitter and collector, respectively, of transistor 130. Capacitor 134 is used to filter any r. f. component still remaining in the signal.

Power is supplied to the super-regenerative detector 26 and the amplifier 28 from a voltage source point 138 which is connected to a voltage source or battery 140 via an on-off switch 142. The other terminal for battery 140 is connected to the receiver circuit ground 110. Voltage point 138 is connected to the super-regenerative detector via a pair of resistors 144 and 146 which are connected in series having their interconnection coupled to ground via a capacitor 148. Amplifier 128 is connected to voltage source point 138 via a resistor 150.

The output of amplifier 28 is generated at the collector of transistor 130 and is connected via a resistor 152 connected in series with a capacitor 154 to a twin-T notch filter circuit 30. The filter circuit 30 is based around an NPN transistor 156 having its base connected to the input signal from capacitor 154. That base is also connected to the series combination of resistors 172 and 174 connected in parallel with the series combination of capacitors 178 and 180. A capacitor 170 connects the parallel combination in a feedback path through the emitter-base junction of another NPN transistor 158 to the collector of transistor 156. The purpose of transistor 158 is essentially impedance matching. A capacitor 176 couples the interconnection of resistors 172 and 174 to the circuit ground 110 and resistor 182 couples the interconnection of capacitors 178 and 180 to the circuit ground 110. Resistors 160 and 162 respectively coupled the emitters of transistors 156 and 158 to the circuit ground 110. The voltage source point 138 is coupled directly to the collector of transistor 158 and through a resistor 168 to the collector of transistor 154. A resistor 164 is connected between the base and collector of transistor 154.

Operationally, the twin-T notch filter circuit 30 allows only those frequencies to pass which are in the immediate vicinity of the frequency generated by the audio frequency signal generator circuit 16 of FIGS. 1 and 2. This helps to eliminate the problem of stray signals associated with other broadcasts which may be capable of triggering the alarm of the present circuit. In the event that a different audio frequency is modulated on the carrier frequency of the present invention, that other audio frequency will not pass through the notch filter 30 and, thus, will not trigger the alarm.

The output of notch filter 30 appears at the emitter of transistor 158 and is connected to an alternating current rectifier circuit 32 comprised of a pair of diodes 184 and 186, a capacitor 190 and a resistor 192. Diodes 184 and 186 are connected as a half wave rectifier bridge and are used to charge the capacitor 190. The resistor 192 bleeds off the charge of capacitor 190 shortly after an alternating current signal ceases to exist at the input to rectifier 32.

The output of the rectifier circuit 32 is coupled to a delay circuit 34. Delay circuit 34 is constructed around a quad NOR gate integrated circuit including four NOR gates 194–197. The input is received by one input of NOR gate 194. A capacitor 198 couples the output of NOR gate 194 to both inputs of NOR gate 195. Another capacitor 200 couples the output of NOR gate 195 to a first input of NOR gate 196. The output of NOR gate 196 is connected to the other input of NOR gate 194. A second other input of NOR gate 196 is connected to the output of NOR gate 194 and also to one input of NOR gate 197. The other input of NOR gate 197 is connected to the connection of capacitor 200 and the first input of NOR gate 196. A reduced supply voltage is provided for the NOR gates 194–197 from the voltage supply point 138 via a voltage dividing network including a series connected pair of resistors 202 and 204. The interconnection therebetween is connected to a terminal 206 which supplies operating power (not shown) to the NOR gates 194–197, which are also connected to the receiver ground 110. The voltage across resistor 204 is also connected via a pair of resistors 208 and 210 to the inputs of NOR gate 195 and the first input of NOR gate 196, respectively.

In operation, the combination of the capacitor 198 and resistor 208 constitute a first delay network means for delaying the activation of any alarm signal until the triggering signal is present for a predetermined amount of time as determined by the time constant of the capacitor 198 with resistor 208. Further, capacitor 200 and resistor 210 constitute a second delay network means for determining a period of time for activation of the alarm signal. When the proper activating or triggering signal is generated at the output of rectifier means 32, the input of one input of NOR gate 194 goes from a logical zero to a logical high. This causes the output of NOR gate 194 to change from a logical high to a logical zero. Prior to the presence of the alarm signal, both inputs of NOR gate 195, which is acting as an inverter gate, are a logical high. When the alarm signal is received and the output of NOR gate 194 goes to a logical zero, the inputs to NOR gate 195 both appear as a logical zero until the capacitor 198 charges to the voltage level which constitutes a logical one. The amount of time taken by capacitor 198 to so charge is determined by its time constant in conjunction with resistor 208. During this time, the activation signal from rectifier means 32 must remain present. If it ceases to exist at any time prior to the full charging of capacitor 198, then the alarm will not be sounded. Again prior to the presence of an alarm signal from rectifier means 32, the output of NOR gate 195 is a logical zero and the input of NOR gate 197 connected to the junction of capacitor 200 and resistor 210 is held at a logical high by the voltage from terminal 206. This initial condition causes the charging of capacitor 200 with little or no consequence. When the activation signal is first received, the output of NOR gate 195 goes to a logical one which quickly discharges capacitor 200, again with no consequence to the alarm signal. When the alarm signal has been received for the predetermined amount of time set by the delay network means of capacitor 198 and resistor 208, the output of NOR gate 195 returns to a logical zero which causes the temporary grounding of the junction between capacitor 200 and resistor 210. This grounding or logical zero is inputted to the NOR gate 197 causing activation of an alarm signal. It is also inputted to NOR gate 196, which along with the logical zero present from the output of NOR gate 194, generates a logical one at the output of NOR gate 196. This is coupled back to the other input of NOR gate 194. This action of NOR gates 194 and 196 causes an interlock of the system to maintain the output of NOR gate 194 during the sounding of the alarm signal, in the event that the activation signal from the rectifier means 32 should cease during this time. Thus, while the activation signal from rectifier means 32 must be present for the predetermined amount of time set by capacitor 198 and resistor 208, it may shortly thereafter cease to exist as the alarm signal will have been activated and the interlock circuit means of the delay circuit means 34 will enable the alarm signal to operate during the period of time set by the capacitor 200 and the resistor 210. As mentioned, the passing of the predetermined amount of time causes the output of NOR gate 195 to go to a logical zero which temporarily places a logical zero or zero volts at the junction between the capacitor 200 and resistor 210, thus sounding the alarm. This causes the capacitor 200 to begin to charge through the resistor 210 and the charging will continue until the voltage at the junction therebetween reaches a logical one voltage level for the inputs of NOR gates 196 and 197. At this point, the interlock signal to NOR gate 194 will cease and the activation signal for the alarm via the upper input of NOR gate 197 will also cease. Thusly, the period of time during which the alarm is activated is determined by the time constant circuit of the capacitor 200 and the resistor 210.

The alarm circuit 36 is connected to the output of NOR gate 197 via a resistor 212 coupled to the base of a transistor 214. The emitter of transistor 214 is connected to the circuit ground 110 and the collector of transistor 214 is connected to an audio alarm device 216. The audio alarm device 216 is also connected to a terminal 218 for the application of positive voltage thereto from the voltage source point 138. In the present embodiment, the transistor 214 is an NPN type and the audio alarm device 216 is a SONALERT piezoelectric transducer available from the Mallory Capacitor Company of Indianapolis, Ind.

What is claimed is:

1. A remote alarm system, comprising:

a transmitter;

circuit means, included in said transmitter for generating an audio frequency electrical signal;

means for activating said circuit means for generating;

modulator circuit means, included in said transmitter and coupled to said circuit means for generating, for forming a current source modulated by said circuit means for generating;

radio frequency oscillator circuit means included in said transmitter and coupled to said modulator circuit means for being modulated by said modulated current source;

antenna means coupled to said radio frequency oscillator circuit means for transmitting signals therefrom;

a receiver;

antenna means for receiving transmissions from said antenna means for transmitting;

super-regenerative detector means included in said receiver and coupled to said antenna means for receiving;

amplifier means included in said receiver and coupled to said detector means for amplifying signals therefrom;

notch filter means included in said receiver and coupled to said amplifier means for selectively filtering the audio frequency of said circuit means for generating;

alternating current rectifier means included in said receiver and coupled to said filter means for converting any said audio frequencies filtered by said filter means into a direct current signal;

delay circuit means, included in said receiver and coupled to said rectifier means, for delaying activation of an alarm signal until said direct current signal is present for a predetermined amount of time and for determining a period of time for activation of an alarm signal; and alarm means coupled to said delay circuit means for generating an alarm signal in response to said delay circuit means.

2. The alarm system of claim 1, wherein said means for generating said audio frequency includes a twin-T oscillator circuit configuration.

3. The alarm system of claim 2, wherein said radio frequency oscillator circuit means includes a crystal controlled frequency.

4. The alarm system of claim 3, wherein said notch filter means includes a twin-T circuit configuration.

5. The alarm system of claim 1, wherein said delay circuit means includes a first delay network means for determining said predetermined amount of time and a second delay network means for determining said period of time for activation.

6. The alarm system of claim 5, wherein said delay circuit means also includes an inverter gate coupling said first and second delay network means.

7. The alarm system of claim 6, wherein said delay circuit means further includes an interlock circuit means having first and second logical NOR gates, each of which includes first and second inputs and an output, said first input of said first NOR gate being coupled to said rectifier means, said second input of said first NOR gate being coupled to said output of said second NOR gate, said output of said first NOR gate being coupled to said first delay network means and to said first input of said second NOR gate, and said second input of said second NOR gate being coupled to said second delay network means.

8. The alarm system of claim 7, wherein said delay circuit means further includes third NOR gate circuit means having a first input coupled to said output of said first NOR gate, a second input coupled to said second input of said second NOR gate, and an output coupled to said alarm means.

* * * * *